United States Patent [19]

Aboudi

[11] 4,308,680

[45] Jan. 5, 1982

[54] SCINTILLATING DECORATIVE DISPLAY DEVICE

[76] Inventor: Aharon Aboudi, 22 Hida St., Bnei Brak, Israel

[21] Appl. No.: 146,067

[22] Filed: May 2, 1980

[30] Foreign Application Priority Data

Mar. 5, 1980 [IL] Israel ..... 59531

[51] Int. Cl.[3] ..... G09F 19/00

[52] U.S. Cl. ..... 40/613; 40/447; 40/617

[58] Field of Search ..... 40/439, 613, 617, 602, 40/447, 477

[56] References Cited

U.S. PATENT DOCUMENTS

| | | | |
|---|---|---|---|
| 3,043,039 | 7/1962 | Battaglia | 40/613 |
| 3,206,882 | 9/1965 | Thatcher | 40/613 |
| 3,298,123 | 1/1967 | Ownbey | 40/613 |
| 4,017,992 | 4/1977 | Kajitani | 40/439 |
| 4,080,747 | 3/1978 | Kato | 40/439 X |

*Primary Examiner*—Gene Mancene
*Assistant Examiner*—G. Lee Skillington
*Attorney, Agent, or Firm*—Kenway & Jenney

[57] ABSTRACT

A scintillating display device comprising a plurality of unit panels mounted on a base panel. Each unit panel has an integral projecting support member of inverted (human) noselike profile, the frontal portion of which is constituted by a vertical ridge and two slightly bevelled side surfaces. The frontal surface is slanted downwardly and rearwardly and merges into the base panel at its bottom. A rivet, with a rivet head, is embedded in the upper part of the support member from which a reflecting disk is freely suspended so as to move and swivel freely in a breeze, whereby a scintillating effect is achieved.

5 Claims, 6 Drawing Figures

FIG. 5
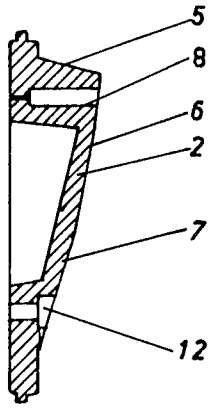
FIG. 4
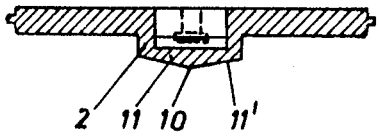
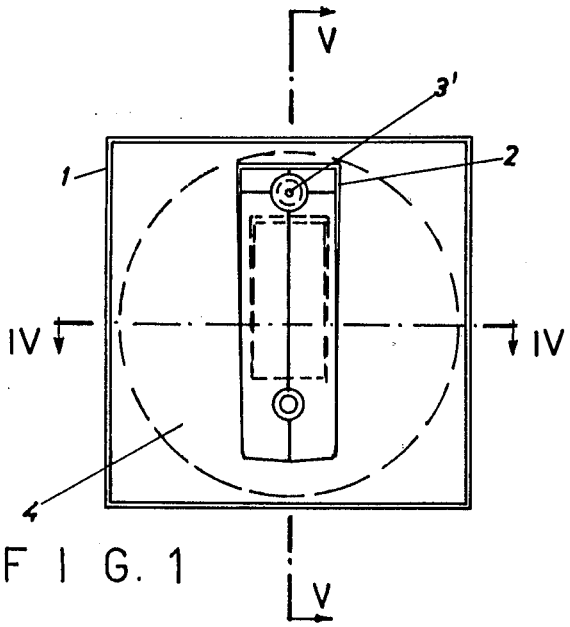
FIG. 1
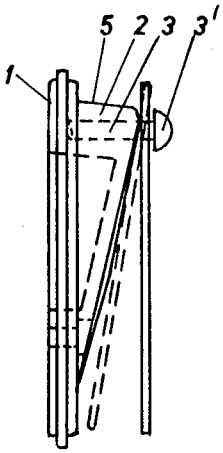
FIG. 2
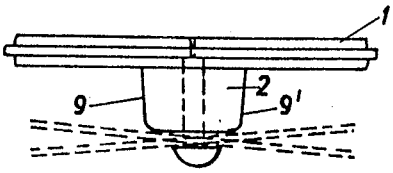
FIG. 3
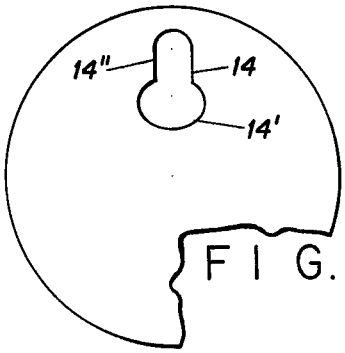
FIG. 6

SCINTILLATING DECORATIVE DISPLAY DEVICE

The present invention concerns a decorative sheet display device for outdoor advertising purposes in which a plurality of light-reflecting disks are each suspended from a rivet or the like projecting from an arm on a base panel to move freely with a breeze of the wind. This kind of device will hereinafter be designated as display device of the kind defined.

Devices of this kind are known from U.S. Pat. Nos. 3,043,039; 3,206,882; 4,017,992 and 4,080,747. Particularly in the two last mentioned patents the disk is supported on an arm which has a downwardly slanting face to guide the movement of the disk when blown by the wind.

One of the drawbacks of this type of suspension is the fact that with wind pressure the moving disk may bend against the supporting base and this contact will prevent further free movement. Furthermore, since the disk supporting arms are located in the upper part of the base unit only, the latter is often not sufficiently stable when supported in an open frame.

It is the object of the present invention to provide a display device of the above mentioned kind wherein the above mentioned drawbacks are overcome while providing a simple, light-weight and cheap product.

The invention consists in a display device of the kind defined, wherein the base panel is subdivided into rows and columns of substantially square unit panels, a reflecting disk being suspended from each of said unit panels, each unit panel having an elongated rectangular supporting member of inverted (human) nose-like profile integral with and projecting from the medial part of its front surface and extending substantially from just below the top to just above the bottom thereof, the projecting member being slightly bevelled on either side of the vertical median line thereof which thus forms a ridge, said ridge being slanted slightly downwardly and rearwardly from just below its top to the middle of its height and at a slightly larger angle at its lower half, a bore being provided just below its top for the reception of a projecting rivet having a rivet head from which the reflecting disk is freely and swingably suspended, said disk, when suspended being substantially coextensive with the unit panel.

In a preferred embodiment of the invention the projecting support member is hollowed out on its underside. The bevelled surfaces on either side of the ridge permit a limited swivelling motion about the ridge, while the top half or the bottom half of the member, as the case may be, will support the disk firmly when it is urged against it by a breeze.

The invention is illustrated, by way of example only, in the accompanying drawings in which:

FIG. 1 is a plan view of a unit panel of a display device according to the invention, the reflecting disk being indicated in dash lines.

FIG. 2 is a side elevation thereof.

FIG. 3 is a top-end view thereof.

FIG. 4 is a section thereof, without the reflecting disk, taken on line IV—IV of FIG. 1.

FIG. 5 is a section thereof, without the reflecting disk and without a rivet, taken on lines V—V of FIG. 1.

FIG. 6 is a fragmentary plan view of an alternative construction of the reflecting disk of FIGS. 1 and 2.

Referring to FIG. 1, a substantially square unit panel 1 made of a suitable plastic material is illustrated. An elongated rectangular supporting member 2 projects from the median portion of the panel and a rivet 3 having a rivet head 3' is embedded in and projecting from near the top of the supporting member 2. A freely moveable circular reflecting disk 4 is suspended from the rivet 3, the diameter of the disk being substantially equal to a side of the square unit panel 1.

The particular outline of panel 1, projecting member 2, rivet 3 and disk 4 as seen from the side, will now be described with reference to FIGS. 2 and 5. As shown, the projecting support member 2 has an inverted (human) nose-like profile, the top surface 5 being substantially horizontal. The front surface is slanted downwardly and rearwardly to merge into the back plate as its lowermost portion. The upper half 6 of the slanting surfaces forms a relatively small angle with the vertical while the lower half 7 is slanted at slightly larger angle therewith. A horizontal bore 8 is provided to receive rivet 3 with rivet head 3' which latter is slightly spaced from the supporting member 2. As indicated in FIGS. 1, 2 and 5 the projecting portion is hollowed out at its underside to save weight and material.

As illustrted in FIGS. 3 ad 4 the vertical side surfaces 9,9' of the projecting portion are both substantially normal to the front surface of unit panel 1. As clearly shown in FIG. 4, the front surface is slightly bevelled at either side of the vertical median line which latter thus forms a ridge 10 with bevelled plane side surfaces 11 and 11'.

As shown in FIGS. 1 and 2 the reflecting disk 4 is of circular shape and has an eccentric hole which is very slightly larger than the shaft of the rivet through which rivet 3 can be freely inserted. An additional throughgoing bore 12 is provided in the lowermost part of the unit panel through which a fixing member such as a nail or screw is inserted to fix the panel to the base plate (not shown) of the device. Each reflecting disk has a reflecting surface which may be produced by vacuum deposition of aluminium vapor on the plastic disk. The aluminium layer may be suitably colored by anodization or the like, as known per se. Alternatively, a thin aluminium foil may be applied to the surface of the plastic disk. Other methods to produce suitable disks are known to the man versed in the art.

In FIG. 2 the disk 2 is shown in continuous line when the air is still. When a breeze blows towards the supporting surface the disk will be applied to the ridge 10 of the supporting member whereupon it will swivel about the ridge until it is arrested by one or the other of the bevelled surfaces 11, 11'. Depending on the direction of the breeze the disk will be applied to the upper or the lower half of the slanted ridge or the bevelled surface areas bordering thereon as shown in FIG. 3. Thus scintillating or shimmering effects will be produced by every slight change of the direction of the breeze, while the disk will always be firmly supported and a bending or damaging of the disk is obviated. As soon as the breeze dies down the disk will return to its vertical position.

In an alternative preferred embodiment shown in FIG. 6, the eccentric hole of the disk may have the shape of a vertical inverted key-hole 14 so that the disk can be easily suspended on and removed from the rivet, which, in this case can be firmly embedded in the unit panel. Interference between vicinal disks is also substantially impossible when the panel is constructed according to the present invention. In this embodiment the lower circular portion 14' of the key hole is substantially equal to the rivet head while the upper elongated part 14'' is slightly wider than the width of the rivet shaft, but narrower than the rivet head, so that the disk can freely swing and swivel on the rivet.

The base panel is of known construction and is therefore not described or illustrated.

A number of slight variations regarding the shape and construction of the components of the display device will present themselves to the man of the art. All these variations are intended to be included in the inventive concept, provided they fall within the ambit of the appended claims.

I claim:

1. Scintillating display apparatus for mounting on a base panel and comprising a unit panel having a reflecting disk suspended therefrom, said unit panel having an elongated rectangular supporting member of inverted nose-like profile integral with and projecting from the median part of the front surface of the unit panel and extending substantially from just below the top of the unit panel to just above the bottom thereof, the supporting member being slightly bevelled on either side of the vertical median line thereof, which thus forms a ridge extending along said inverted profile, said ridge being slanted slightly downwardly and rearwardly from just below the top of the supporting member to substantially the middle of the height thereof and at a slightly larger angle at the lower half thereof, a bore being provided just below the top of the supporting member for the reception of a projecting rivet having a rivet head from which the reflecting disk is freely and swingably suspended, said disk, when suspended, being substantially coextensive with the unit panel.

2. Display apparatus as claimed in claim 1, wherein the projecting supporting member is hollowed out on its underside.

3. Display apparatus as claimed in claim 1, wherein the unit panel has a bottom portion below said supporting member and has a mounting hole approximately at the center of said bottom portion and through which said panel can be secured to a base panel by means of a fixing member.

4. Display apparatus as claimed in claim 1, wherein the disk has an eccentric hole from which it is suspended from the unit panel and which is slightly larger than the shaft of the rivet, which passes through said suspending hole.

5. Display apparatus as claimed in claim 4, wherein the eccentric hole is of inverted keyhole outline, the diameter of the circular part thereof being substantially equal to that of the rivet head while the width of the elongated part is substantially equal to the diameter of the rivet-shaft.

* * * * *